US010789873B2

(12) United States Patent
Guo

(10) Patent No.: US 10,789,873 B2
(45) Date of Patent: Sep. 29, 2020

(54) DRIVING DEVICE AND DRIVING METHOD OF DISPLAY DEVICE

(71) Applicants: HKC Corporation Limited, Shenzhen (CN); Chongqing HKC Optoelectronics Technology Co., ltd., Chongqing (CN)

(72) Inventor: Dongsheng Guo, Chongqing (CN)

(73) Assignees: HKC CORPORATION LIMITED, Shenzhen (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 0 days.

(21) Appl. No.: 16/141,022

(22) Filed: Sep. 25, 2018

(65) Prior Publication Data

US 2019/0066565 A1 Feb. 28, 2019

Related U.S. Application Data

(63) Continuation of application No. PCT/CN2018/100591, filed on Aug. 15, 2018.

(30) Foreign Application Priority Data

Aug. 23, 2017 (CN) ..... 2017 1 0731808

(51) Int. Cl.
*G09G 3/36* (2006.01)
*G09G 3/20* (2006.01)

(52) U.S. Cl.
CPC ..... *G09G 3/2003* (2013.01); *G09G 3/2092* (2013.01); *G09G 2300/0426* (2013.01); *G09G 2310/08* (2013.01); *G09G 2370/08* (2013.01); *G09G 2370/14* (2013.01)

(58) Field of Classification Search
CPC ... G09G 3/36; G09G 3/30; G09G 5/00; G06F 3/038
See application file for complete search history.

(56) References Cited

U.S. PATENT DOCUMENTS

2003/0085885 A1* 5/2003 Nakayoshi ..... G09G 3/3225 345/205
2007/0057877 A1* 3/2007 Choi ..... G09G 3/3233 345/76
2017/0061872 A1* 3/2017 Zhou ..... G09G 3/3233

* cited by examiner

*Primary Examiner* — Pegeman Karimi
(74) *Attorney, Agent, or Firm* — WPAT, PC

(57) ABSTRACT

The present invention relates to a driving device and a driving method of a display device, and the driving device of the display device includes a timer control module, a driving module and a plurality of sets of data lines. Wherein the output terminal of the timer control module outputs a plurality of data signals of different color sub-pixels; the receiving terminal of the driving module receives the data signal from the timer control module; wherein the plurality of sets of data lines are connected to the timer control module and the driving module, two or more than two sets of the data lines connecting to the driving module for transmitting the data signal of the same color sub-pixel are short connected, and after the short connected are connected to the output terminal of the timer control module through a set of data lines.

19 Claims, 10 Drawing Sheets

| | P1 | P2 | P3 | P4 | | P3839 | P3840 |
|---|---|---|---|---|---|---|---|
| G1 | 11 | 11 | 12 | 12 | | 11920 | 11920 |
| G2 | 11 | 11 | 12 | 12 | | 11920 | 11920 |
| G3 | 21 | 21 | 22 | 22 | | 21920 | 21920 |
| G4 | 21 | 21 | 22 | 22 | | 21920 | 21920 |
| G2159 | 10801 | 10801 | 10802 | 10802 | | 1080 1920 | 1080 1920 |
| G2160 | 10801 | 10801 | 10802 | 10802 | | 1080 1920 | 1080 1920 |

DRIVING DEVICE AND DRIVING METHOD OF DISPLAY DEVICE

FIELD OF THE DISCLOSURE

The disclosure relates to a display technical field, and more particularly to a driving device and a driving method of a display device.

BACKGROUND

The ultra high definition, UD display panel usually uses timer control register, TCON for UD to perform the design of the printed circuit board assembly, PCBA for the display of the UD panel.

However, it is inevitable that there are some defective UD display panel need to be detection, the exemplary detection program is to use the timer control register for UD to control the driver to turn on the UD display panel, to achieve the detection of the display panel. The exemplary detection program requires the input of data signal of the UD resolution to drive to turn on the UD display panel, so that the architecture of the driving circuit is complicated and costly.

SUMMARY

Based on this, it is necessary to provide a driving device and a driving method for a display device in view of the complicated architecture and costly problem of the driving circuit.

A driving device for a display device, including a timer control module, a driving module and a plurality of sets of data lines;

Wherein, an output terminal of the timer control module outputting a plurality of sets of data signals of different color sub-pixels; a receiving terminal of the driving module receiving the data signals from the timer control module; and wherein the plurality of sets of data lines are connected to the timer control module and the driving module, two or more than two sets of the data lines connecting to the driving module for transmitting the data signal of the same color sub-pixel are short connected, and are connected to the output terminal of the timer control module through a set of data lines after the short connection.

In one embodiment, the driving device of the display device further Including a low voltage differential signal interface, and the driving module is a source driving module; the low voltage differential signal interface connected to the output terminal of the timer control module and the receiving terminal of the source driving module, respectively;

The low voltage differential signal interface including two signal paths, a first signal path and a second signal path, respectively; each signal path including six sets or three sets of data lines and a set of clock signal lines;

The six sets of data line are a first set of data lines, a second set of data lines, a third set of data lines, a fourth set of data lines, a fifth set of data lines, a sixth set of data lines, sequentially;

The three sets of data line are the first set of data lines, the second set of data lines, the third set of data lines, sequentially;

The set of clock signal lines are first clock signal lines;

The first set of data lines and the fourth set of data lines transmit red sub-pixel data signals;

The second set of data lines and the fifth set of data lines transmit green sub-pixel data signals; and The third set of data lines and the sixth set of data lines transmit blue sub-pixel data signals.

In one embodiment, each of the signal path includes six sets of data lines;

The first set of data lines, the second set of data lines, and the third set of data lines of the first signal path are short connected to the corresponding first set of data lines, the second set of data lines, the third set of data lines of the second signal path, respectively;

The fourth set of data lines, the fifth set of data lines, and the sixth set of data lines of the first signal path are short connected to the corresponding fourth set of data lines, the fifth set of data lines, the sixth set of data lines of the second signal path, respectively; and The first clock signal line of the first signal path is short connected to the first clock signal line of the second signal path.

In one embodiment, each of the signal path includes six sets of data lines;

The first set of data lines, the second set of data lines, and the third set of data lines of the first signal path are short connected to the corresponding fourth set of data lines, the fifth set of data lines, the sixth set of data lines of the second signal path, respectively;

The fourth set of data lines, the fifth set of data lines, and the sixth set of data lines of the first signal path are short connected to the corresponding first set of data lines, the second set of data lines, the third set of data lines of the second signal path, respectively; and The first clock signal line of the first signal path is short connected to the first clock signal line of the second signal path.

In one embodiment, each of the signal path includes six sets of data lines;

The first set of data lines and the fourth set of data lines of the first signal path are short connected to the corresponding first set of data lines and the fourth set of data lines of the second signal path, respectively;

The second set of data lines and the fifth set of data lines of the first signal path are short connected to the corresponding second set of data lines and the fifth set of data lines of the second signal path, respectively;

The third set of data lines and the sixth set of data lines of the first signal path are short connected to the corresponding third set of data lines and the sixth set of data lines of the second signal path, respectively;

The first clock signal line of the first signal path is short connected to the first clock signal line of the second signal path.

In one embodiment, each of the signal path includes three sets of data lines;

The first set of data lines, the second set of data lines and the third set of data lines of the first signal path are short connected to the corresponding first set of data lines, the second set of data lines and the third set of data lines of the second signal path, respectively; and The first clock signal line of the first signal path is short connected to the first clock signal line of the second signal path.

In one embodiment, the low voltage differential signal interface includes a signal path, the signal path includes six sets of data lines; and The first set of data lines, the second set of data lines and the third set of data lines are short connected to the corresponding fourth set of data lines, the fifth set of data lines and the sixth set of data lines, respectively.

In one embodiment, further including a gate driving module; the gate driving module connected to the timer control module, and outputting driving voltage signals through a plurality of sets of scanning lines, and each set of scanning lines including a plurality of adjacent scanning lines; and The timer control module controlling the gate driving module to output the driving voltage signals, making the driving voltage signals of the scanning lines in each set of scanning lines synchronized, and each set of scanning lines sequentially transmitting the driving voltage signals.

A driving method of a display device, including:

Acquiring a plurality of sets of data signals of the different color sub-pixels outputting from a timer control register;

Short connecting two or more than two sets of data lines transmitting the data signals having same color sub-pixels; and Connecting the short-connected data lines to the timer control register through a set of data lines.

A driving device of the display device, including:

A timer control module, an output terminal of the timer control module outputting a plurality of sets of data signals of different color sub-pixels to a source driving module;

The source driving module, wherein two sets of the data lines for transmitting the data signal of the same color sub-pixel of the source driving modules are short connected, and are connected to the output terminal of the timer control module through a set of data lines after the short connection; and A gate driving module, wherein the gate driving module is connected to the timer control module, and is for outputting driving voltage signals through a plurality of sets of scanning lines, and the driving voltage signals of two adjacent scanning lines of the scanning lines of each set are synchronized.

The driving device and the driving method of the display device described above are designed by the short connection of the data lines on the output path of the timer control module, making the receiving data of the driving module is multiplexed, so that the display panel driving method with lower resolution can be applied to the display panel of higher resolution. The driving device and the driving method of the display device described above simplifies the drive circuit architecture, reducing production costs.

BRIEF DESCRIPTION OF THE DRAWINGS

Accompanying drawings are for providing further understanding of embodiments of the disclosure. The drawings form a part of the disclosure and are for illustrating the principle of the embodiments of the disclosure along with the literal description. Apparently, the drawings in the description below are merely some embodiments of the disclosure, a person skilled in the art can obtain other drawings according to these drawings without creative efforts. In the FIGS..

DETAILED DESCRIPTION OF PREFERRED EMBODIMENTS

Figure 1:
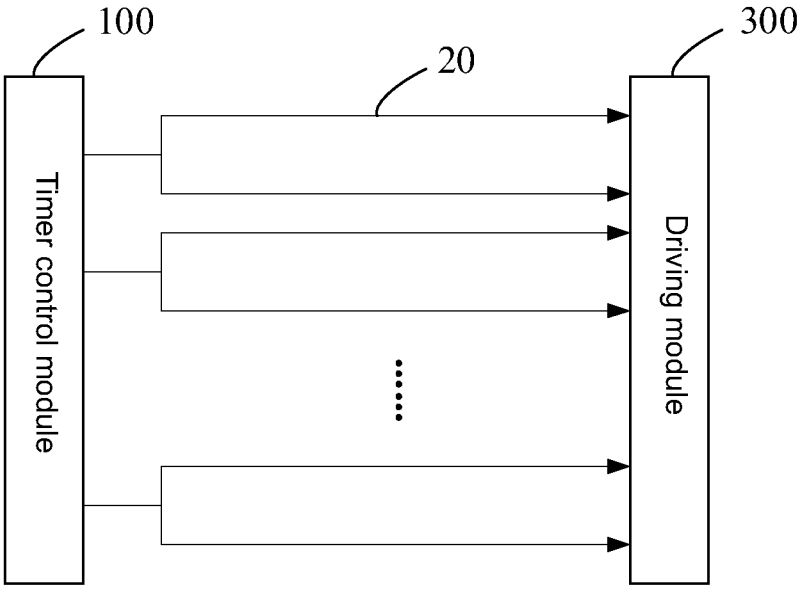
FIG. 1 is a schematic view of a driving device of a display device according to an embodiment.

The specific structural and functional details disclosed herein are only representative and are intended for describing exemplary embodiments of the disclosure. However, the disclosure can be embodied in many forms of substitution, and should not be interpreted as merely limited to the embodiments described herein.

In the description of the disclosure, terms such as "center", "transverse", "above", "below", "left", "right", "vertical", "horizontal", "top", "bottom", "inside", "outside", etc. for indicating orientations or positional relationships refer to orientations or positional relationships as shown in the drawings; the terms are for the purpose of illustrating the disclosure and simplifying the description rather than indicating or implying the device or element must have a certain orientation and be structured or operated by the certain orientation, and therefore cannot be regarded as limitation with respect to the disclosure. Moreover, terms such as "first" and "second" are merely for the purpose of illustration and cannot be understood as indicating or implying the relative importance or implicitly indicating the number of the technical feature. Therefore, features defined by "first" and "second" can explicitly or implicitly include one or more the features. In the description of the disclosure, unless otherwise indicated, the meaning of "plural" is two or more than two. In addition, the term "include" and any variations thereof are meant to cover a non-exclusive inclusion.

In the description of the disclosure, is should be noted that, unless otherwise clearly stated and limited, terms "mounted", "connected with" and "connected to" should be understood broadly, for instance, can be a fixed connection, a detachable connection or an integral connection; can be a mechanical connection, can also be an electrical connection; can be a direct connection, can also be an indirect connection by an intermediary, can be an internal communication of two elements. A person skilled in the art can understand concrete meanings of the terms in the disclosure as per specific circumstances.

The terms used herein are only for illustrating concrete embodiments rather than limiting the exemplary embodiments. Unless otherwise indicated in the content, singular forms "a" and "an" also include plural. Moreover, the terms "include" and/or "include" define the existence of described features, integers, steps, operations, units and/or components, but do not exclude the existence or addition of one or more other features, integers, steps, operations, units, components and/or combinations thereof.

The disclosure will be further described in detail with reference to accompanying drawings and preferred embodiments as follows.

FIG. 1 is a schematic view of a driving device of a display device according to an embodiment; the system includes a timer control module 100, a plurality of sets of data lines 20, and a driving module 300. Specifically, an output terminal of the timer control module 100 outputs a plurality of sets of data signals of different color sub-pixels. A receiving terminal of the driving module 300 receives the data signals from the timer control module 100. The plurality of sets of data lines 20 is connected to the timer control module 100 and the driving module 300, two or more than two sets of the data lines transmitting the data signal of the same color sub-pixel short connected and connected to the driving module 300, and connected to the output terminal of the timer control module 100 through a set of data lines after the short connection.

Specifically, the data signal outputted from the output terminal of the timer control module 100 includes RGB data signals. That is, data signals of red, green and blue three sub-pixels. The data signals are transmitted through a plurality of sets of data lines, if the data lines for transmitting the same color sub-pixel information are shorted, the data lines receiving the same color sub-pixel information at the receiving terminal of the driving module 300 share one data output port. Therefore, by the above-described shorting method, when the image data information with a lower resolution is inputted, it can be displayed on the display panel of the higher resolution.

Figure 2:
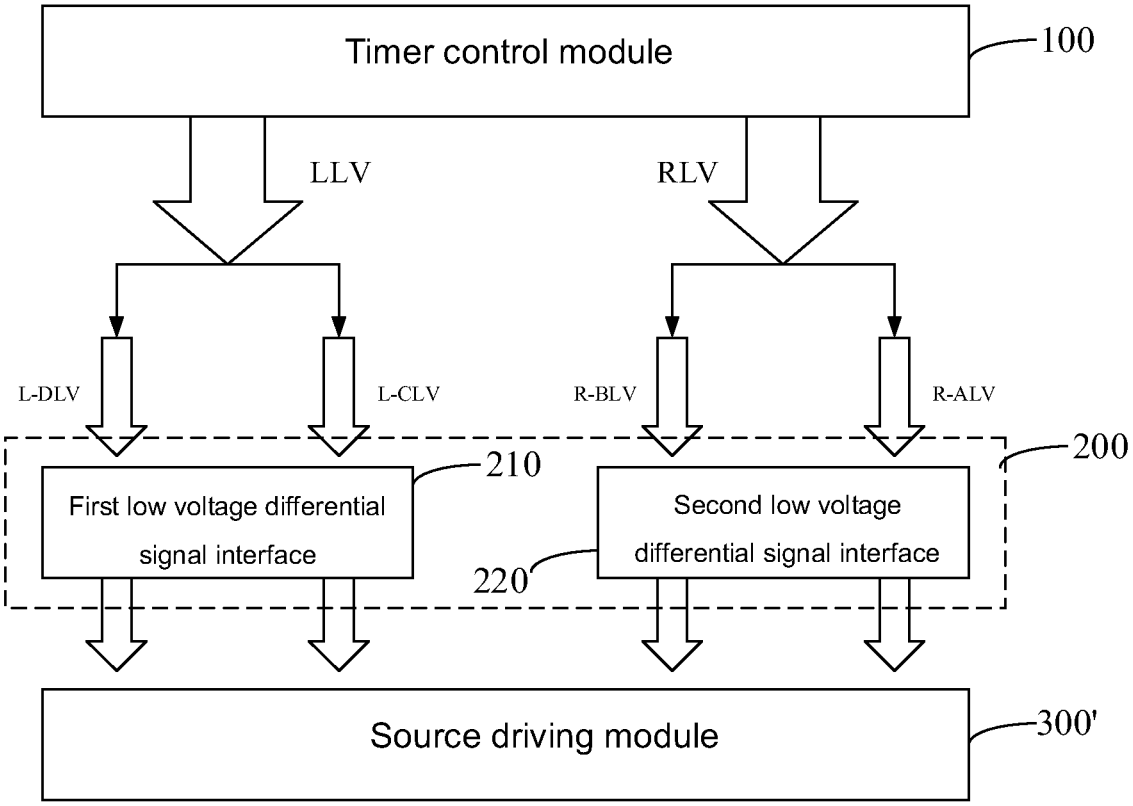
FIG. 2 is a schematic view of a driving device of a display device according to another embodiment.

In one embodiment, as shown in FIG. 2, the driving device of a display device further includes a low voltage differential signal interface 200, and the driving module 300 is a source driving module 300'. The low voltage differential signal interface 200 is connected to the output terminal of the timer control module 100 and the receiving terminal of the source driving module 300', respectively. In the present embodiment, the low voltage differential signal interface 200 is a high-speed serial interface, the data transmission direction of the interface is unidirectional, the data can only be transmitted from the timer control module to the source driving module 300'. Moreover, the low voltage differential signal interface produces very low electromagnetic interference, providing high bandwidth for driving the display.

Specifically, the timer control module 100 outputs data information through a dual bus, each bus carrying the data information of the left half panel and the right half panel, respectively. The corresponding buses are denoted LLV and RLV, respectively. Further, each bus contains a plurality of sets of data lines, each of sets of data lines carries a differential data signal and a control signal.

Specifically, the low voltage differential signal interface 200 includes a first low voltage differential signal interface 210 and a second low voltage differential signal interface 220. Wherein the first low voltage differential signal interface 210 is used to transmit the data information of the left half panel and the second low voltage differential signal interface for transmitting the data information of the right half panel. Further, the first low voltage differential signal interface includes two signal paths, L-CLV and L-DLV. Each signal path includes a plurality of sets of data lines and a set of clock signal lines. Similarly, the second low voltage differential signal interface includes R-ALV and R-BLV two signal paths, each signal path also includes a plurality of sets of data lines and a set of clock signal lines. It will be appreciated that, the structures of the first low voltage differential signal interface and the second low voltage differential signal interface are identical, and the functions of them are to transmit the data signals from the timer control module 100 to the source driving module 300'. In addition, the number of signal paths is related to the type of display panel. For example, the ultra-high definition display panel corresponds to two low voltage differential signal interfaces, each low voltage differential signal interface has two signal paths, and there are four signal paths in total. While the full high definition display panel only corresponds to two signal paths.

Figure 3:
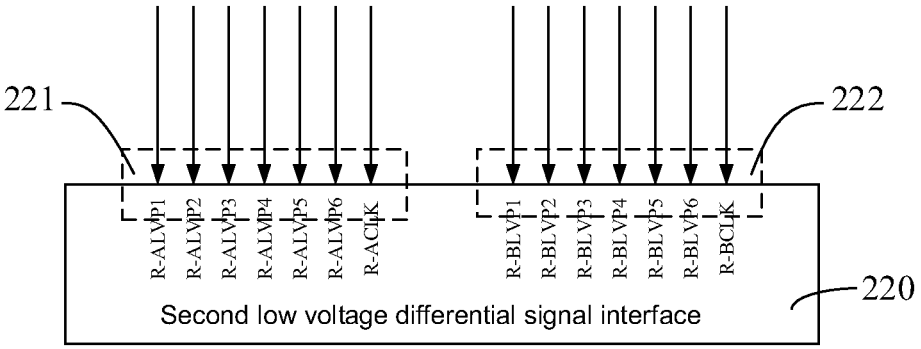
FIG. 3 is a schematic diagram of a low voltage differential signal interface of an embodiment.

In one embodiment, as shown in FIG. 3, the second low voltage differential signal interface 220 is provided with two signal paths, a first signal path 221 and a second signal path 222, respectively; each signal path includes six sets of data lines, and a set of clock signal lines. Wherein, six sets of data line of the first signal path 221 is as followed: a first set of data lines R-ALVP1, a second set of data lines R-ALVP2, a third set of data lines R-ALVP3, a fourth set of data lines R-ALVP4, a fifth set of data lines R-ALVP5, a sixth set of data lines R-ALVP6. Six sets of data line of the second signal path 222 is as followed: a first set of data lines R-BLVP1, a second set of data lines R-BLVP2, a third set of data lines R-BLVP3, a fourth set of data lines R-BLVP4, a five set of data lines R-BLVP5, a sixth set of data lines R-BLVP6. A set of clock signal lines are: a first clock signal line R-ACLK and a first clock signal line R-BCLK.

Specifically, the first set of data lines R-ALVP1 (R-BLVP1) and the fourth set of data lines R-ALVP4 (R-BLVP4) transmit red (R) sub-pixels data signals; the second set of data lines R-ALVP2 (R-BLVP2) and the fifth set of data lines R-ALVP5 (R-BLVP5) transmit green (G) sub-pixel data signals; the third set of data lines R-ALVP3 (R-BLVP3) and the sixth set of data lines R-ALVP6 (R-BLVP6) transmits the blue (B) sub-pixel data signals.

Figure 4:
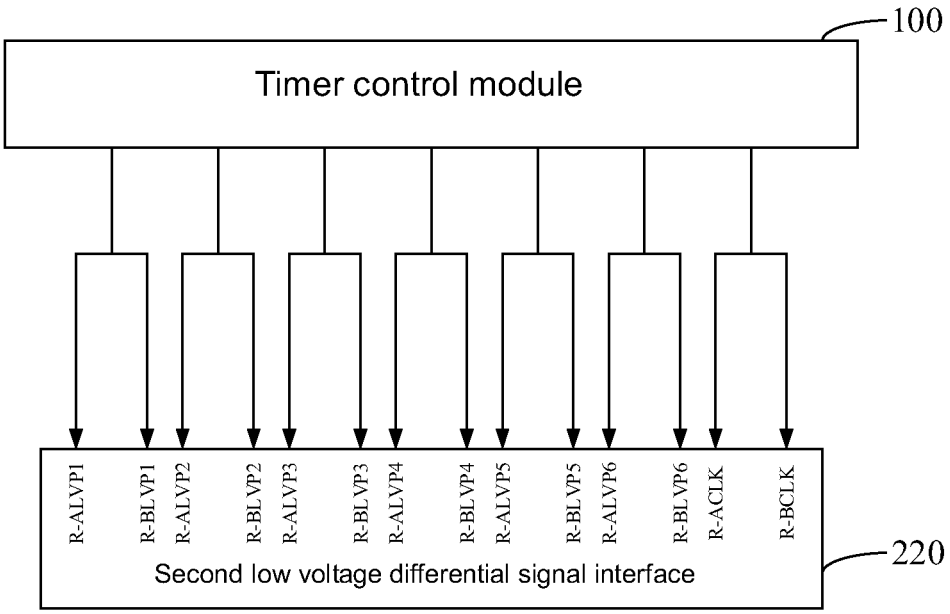
FIG. 4 is a schematic diagram of a short connection of data line of an embodiment.

Further, as shown in FIG. 4, for the present embodiment, the short connection of the data lines at the output terminal of the timer control module 100 is:

The first set of data lines R-ALVP1, the second set of data lines R-ALVP2, and the third set of data lines R-ALVP3 of the first signal path are short connected to the corresponding first set of data lines R-BLVP1, the second set of data lines R-BLVP2, the third set of data lines R-BLVP3 of the second signal path. And, The fourth set of data lines R-ALVP4, the fifth set of data lines R-ALVP5, and the sixth set of data lines R-ALVP6 of the first signal path are short connected to the corresponding fourth set of data lines R-BLVP4, the fifth set of data lines R-BLVP5, the sixth set of data lines R-BLVP6 of the second signal path;

In addition, the first clock signal line R-ACLK of the first signal path is short connected to the first clock signal line R-BCLK of the second signal path.

Further, for the present embodiment, the receiving data of the receiving terminal of the source driving module 300' is multiplexed as shown in Table 1 below:

TABLE 1

| Device | Data line | UD mode | UCFT mode |
|---|---|---|---|
| TCON | R-ALVP1~R-ALVP3 | P1→P3→ . . . →P959 | P1→P3→ . . . →P957→P959 |
| | R-ALVP4~R-ALVP6 | P2→P4→ . . . →P960 | P2→P4→ . . . →P958→P960 |
| | R-BLVP1~R-BLVP3 | P961→P963→ . . . → P1919 | (Short to R-ALVP1~R-ALVP3) |
| | R-BLVP4~R-BLVP6 | P962→P964→ . . . → P1920 | (Short to R-ALVP4~R-ALVP6) |
| S-COF | R-ALVP1~R-ALVP3 | P1→P3→ . . . →P959 | P1(P1/P2)→P3(P5/P6)→ . . . →P479(P957/P958) |
| | R-ALVP4~R-ALVP6 | P2→P4→ . . . →P960 | P2(P3/P4)→P4(P7/P8)→ . . . →P480(P959/P960) |
| | R-BLVP1~R-BLVP3 | P961→P963→ . . . → P1919 | P481(P961/P962)→P483(P965/P966)→ . . . →P959(P1917/P1918) |
| | R-BLVP4~R-BLVP6 | P962→P964→ . . . → P1920 | P482(P963/P964)→P484(P967/P968)→ . . . →P960(P1919/P1920) |

wherein, the TCON shown in the device column represents the timer control module 100, the S-COF represents the source driving module 300'. The data line column represents a plurality of sets of data lines of the output terminal of the timer control module 100 and a plurality of sets of data lines of the receiving terminal of the source driving module 300'. The above table lists the six sets of data lines for R-ALVP1 to R-ALVP6.

The UD mode column represents the data lines distribution for the display panel in UD mode. Specifically, the resolution of display panel of the UD mode is 3840*2160, that is, the display panel has 3840 data lines and 2160 scanning lines. The P1→P3→ . . . →P959, P2→P4→ . . . →P960, P961→P963→ . . . →P1919 and P962→P964→ . . . →P1920 represent the P1 to P 1920 data lines of the right half display panel of the UD mode, that is half of 3840.

The UCFT represents "UD CELL FHD TCON", that is, the UD display panel adapts the full HD timer control module. The UCFT mode in the table above represents: In UCFT mode, the arrangement of the data lines of the display panel, and the data multiplexing situation of the data line. For example, P1(P1/P2) represents that the P1 and P2 data lines in the UD display panel are multiplexed so that the transmission data of the two data lines are identical, so that the data transmitted by the data line P1 in the UCFT mode can be used to represent the data transferred by P1 and P2 of the UD Display panel.

In addition, the "short to R-ALVP1 to R-ALVP3" in the above table represents that the data lines R-ALVP1 to R-ALVP3 of the first signal path are short connected to the data lines R-BLVP1 to R-BLVP3 of the corresponding second signal path.

Figure 5:
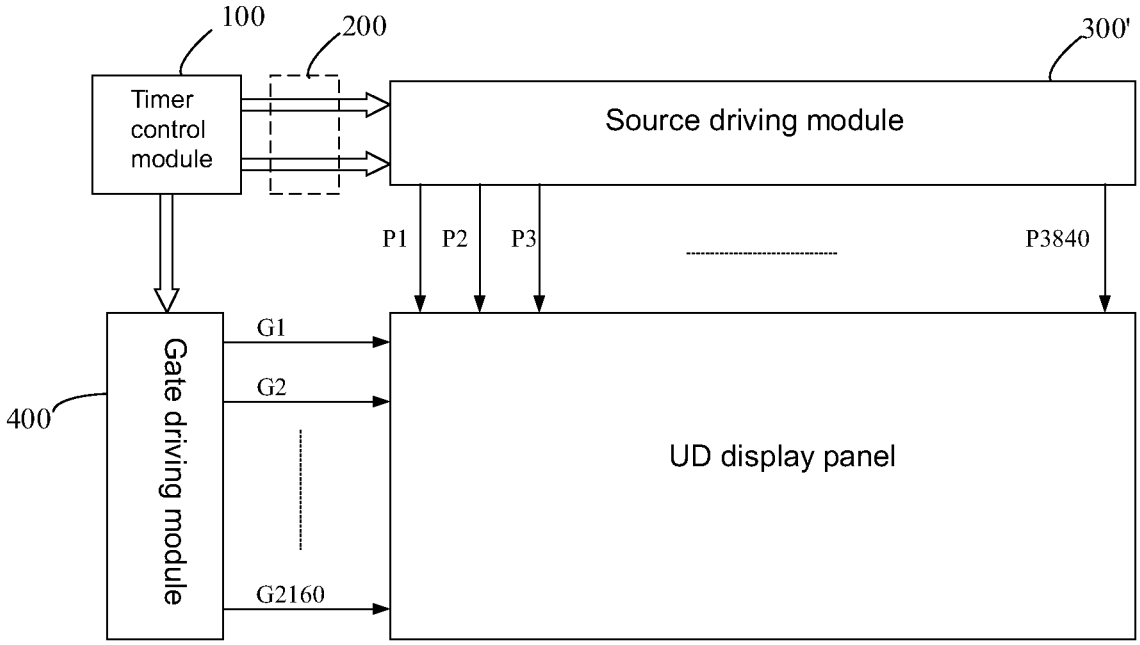
FIG. 5 is a schematic view of a driving device of a display device according to another embodiment.

Further, the driving device of the display device of the present embodiment further includes a gate driving module 400, as shown in FIG. 5, the gate driving module 400 is connected to the timer control module 100, and outputs driving voltage signals through a plurality of sets of scanning lines, and each set of scanning lines includes two adjacent scanning lines. For example, the scanning lines G1 and G2 are two adjacent scanning lines. For the UD display panel, the gate driving module 400 is connected to the UD display panel with 2160 scanning lines, G1, G2, . . . and G2160, respectively. The adjacent two scanning lines are divided into a set, namely: G1 and G2 for a set, G3 and G4 as a set, and so on, to have 1080 sets of scanning lines. On the other hand, the source driving module 300 is connected to the UD display panel with 3840 data lines, P1, P2, . . . and P3840, respectively. In addition, the timer control module 100 and the source driving module 300' are connected through the low voltage differential signal interface 200.

Figure 6:
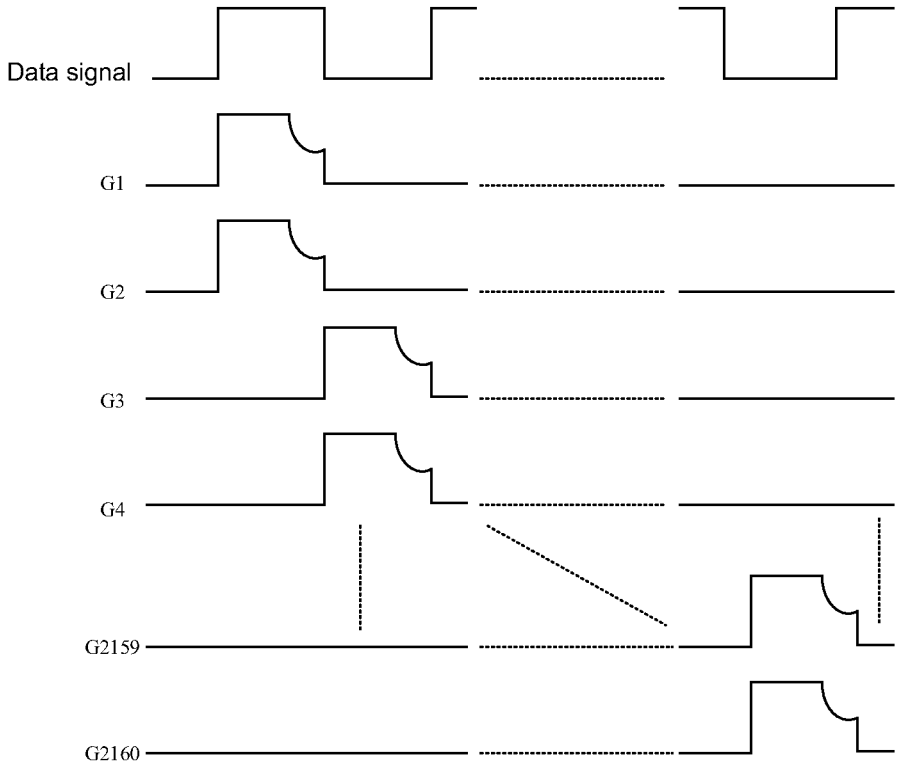
FIG. 6 is a schematic diagram of a scanning line driving signal of an embodiment.

Specifically, the timer control module 100 controls the gate driving module 400 to output the driving voltage signal, so that the driving voltage signals of the scanning lines in each set of scanning lines are synchronized, and the respective sets of scanning lines sequentially transmit the driving voltage signals. As shown in FIG. 6, FIG. 6 shows the driving voltage signals outputted by the gate driving module of the UD display panel. There are 2160 scanning lines in the figure, dividing each two of them into sets. Such as: G1 and G2 for the first set of adjacent scanning lines, G3 and G4 for the second set of adjacent scanning lines, and so on. When the gate driving module outputs the driving voltage signal, the first set of adjacent scanning lines G1 and G2 outputs the same driving voltage signal, and sequentially outputs the driving voltage signals of the respective scanning lines until the last set of adjacent scanning lines G2159 and G2160. That is, the gate driving voltage signal is outputted in pairs, so that the driving voltage signal outputted from the gate driving module is reduced to the original half.

Figure 7:
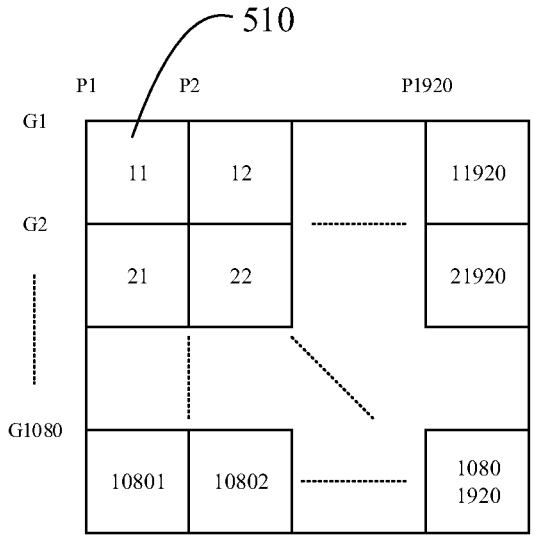
FIG. 7 is a schematic diagram of a full high definition image of an embodiment.
Figures 8, 9:
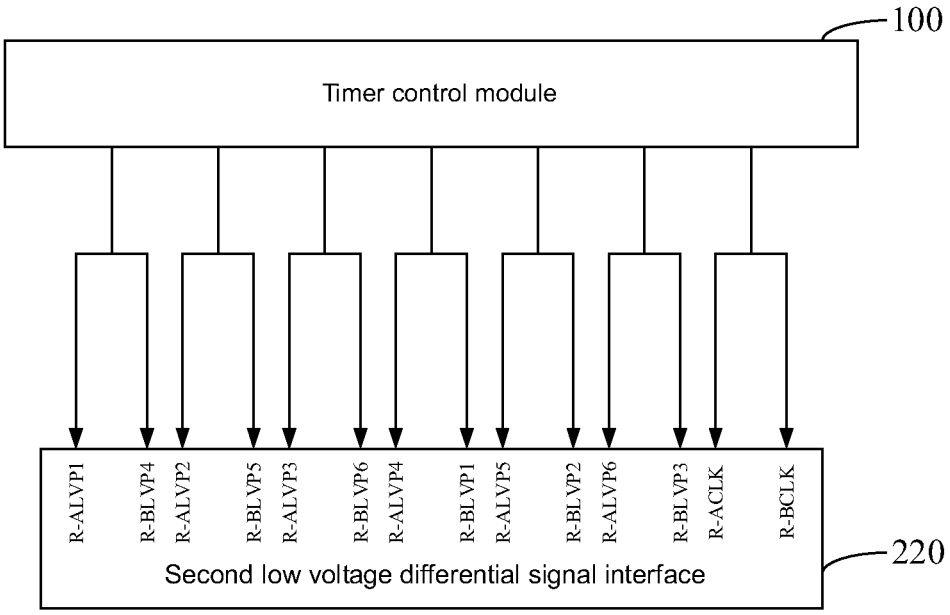
FIG. 8 is a schematic diagram of an ultra high definition image of an embodiment.
FIG. 9 is a schematic diagram of a short connection of data line of another embodiment.

In the present embodiment, by the short connection of the data lines of the output terminal of the timer control module 100, so that the receiving data of the receiving terminal of the source driving module 300' is multiplexed, to realize the using of the timer control module of the FHD to control and drive the UD display panel. As shown in FIG. 7, the figure describes the image display of the FHD. Specifically, the FHD display panel has a total of 1080 scanning lines, that is G1 to G1080; and 1920 data lines, that is P1 to P1920. The numerals in the sub-pixel 510 in the figure represents the data information displayed by the sub-pixel, and do not represent the image screen that is actually displayed. As shown in FIG. 8, the figure describes the image display of the UD. Specifically, the UD display panel has a total of 2160 scanning lines, that is G1 to G2160; and 3840 data lines, that is P1 to P3840. By the shorted connection of the data lines makes the data information transmitted by the data lines P1 and P2, P3 and P4 . . . P3839 and P3840 in the display panel of the UD display in FIG. 8, is respectively the same as the data information transmitted by the P1, P2 P1920 in the display panel of the FHD in FIG. 7. That is as described in Table 1:

P1(P1/P2)→P3(P5/P6)→ . . . →P479(*P*957/P958)

P2(P3/P4)→P4(P7/P8)→ . . . →P480(*P*959/P960)

P481(P961/P962)→P483(P965/P966)→ . . . →P959 (P1917/P1918)

P482(P963/P964)→P484(P967/P968)→ . . . →P960 (P1919/P1920)

Here, the case described in Table 1 is a case where only half of the data lines of the UD display panel of FIG. 8 are transmitted.

On the other hand, the scanning lines G1 and G2, G3 and G4 . . . G2159 and G2160 of the display panel of the UD in FIG. 8 have the same driving voltage signal, respectively, that is, the driving mode of the scanning line is changed from row by row to paired driving.

Therefore, in the UCFT mode, the image information inputting to the display panel of the FHD can be displayed on the UD display panel.

In one embodiment, as shown in FIG. 9, the short connection of the data line of the output terminal of the timer control module 100 may also be:

The first set of data lines R-ALVP1, the second set of data lines R-ALVP2, and the third set of data lines R-ALVP3 of the first signal path are short connected to the corresponding fourth set of data lines R-BLVP4, the fifth set of data line R-BLVP5, the sixth set of data lines R-BLVP6 of the second signal path, respectively. And, The fourth set of data lines R-ALVP4, the fifth set of data lines R-ALVP5, and the sixth set of data lines R-ALVP6 of the first signal path are short connected to the corresponding first set of data lines R-BLVP1, the second set of data lines R-BLVP2, the third set of data lines R-BLVP3 of the second signal path, respectively.

The first clock signal line of the first signal path is short connected to the first clock signal line of the second signal path.

Figure 10:
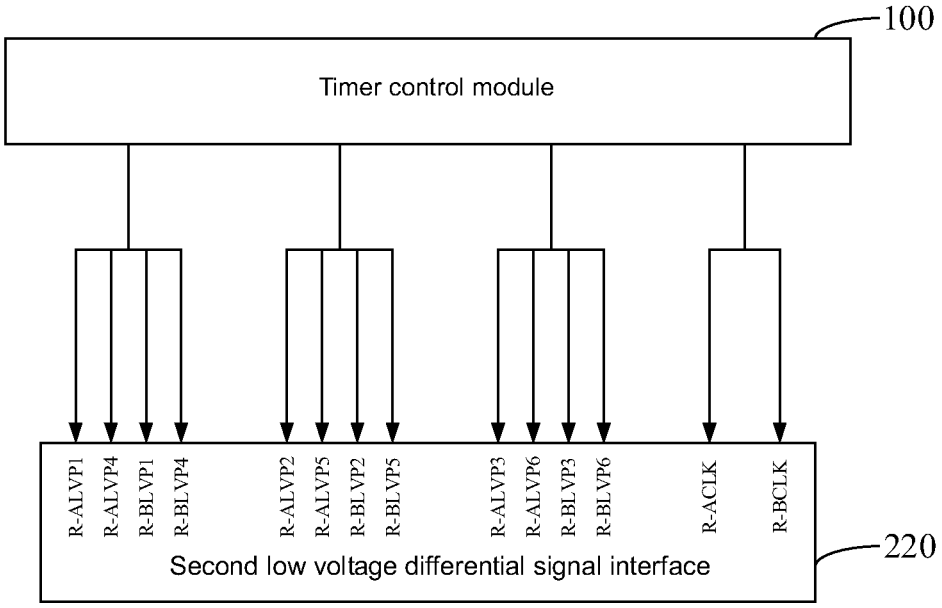
FIG. 10 is a schematic diagram of a short connection of data line of another embodiment.

In one embodiment, as shown in FIG. 10, the short connection of the data line of the output terminal of the timer control module 100 may also be:

The first set of data lines R-ALVP1, the fourth set of data lines R-ALVP4 of the first signal path are short connected to the corresponding first set of data lines R-BLVP1 and the fourth set of data lines R-BLVP4 of the second signal path, respectively.

The second set of data lines R-ALVP2, the fifth set of data lines R-ALVP5 of the first signal path are short connected to the corresponding second set of data lines R-BLVP2 and the fifth set of data lines R-BLVP5 of the second signal path, respectively.

The third set of data lines R-ALVP3, the sixth set of data lines R-ALVP6 of the first signal path are short connected to the corresponding third set of data lines R-BLVP3 and the sixth set of data lines R-BLVP6 of the second signal path, respectively.

The first clock signal line R-ACLK of the first signal path is short connected to the first clock signal line R-BCLK of the second signal path.

In the present embodiment, each of the adjacent four scanning lines output by the gate driving module has the same driving voltage signal, i.e., the scanning lines G1, G2, G3 and G4 have the same driving voltage signal, and so on.

Figure 11:
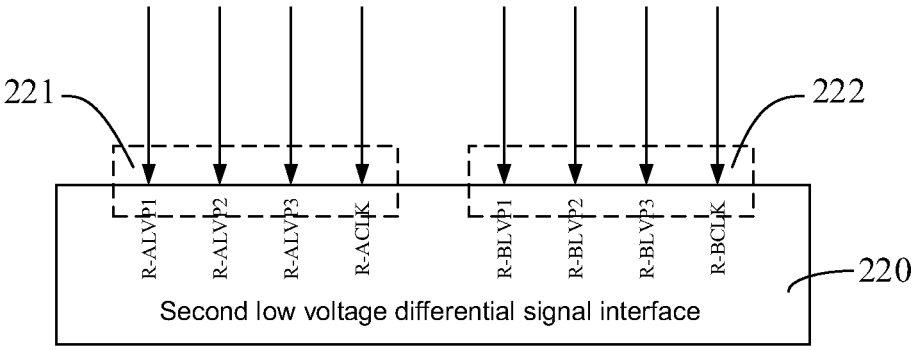
FIG. 11 is a schematic diagram of a low voltage differential signal interface of another embodiment.

In one embodiment, the second low voltage differential signal interface 220 is provided with two signal paths, a first signal path 221 and a second signal path 222, respectively; each signal path includes three sets of data lines and a set of clock signal line. As shown in FIG. 11, the three sets of data lines of the first signal path 221 are sequentially the first set of data lines R-ALVP1, the second set of data lines R-ALVP2 and the third set of data lines R-ALVP3; the three sets of data lines of the second signal path 222 are sequentially the first set of data lines R-BLVP1, the second set of data lines R-BLVP2 and the third set of data lines R-BLVP3. A set of clock signal lines are: the first clock signal line R-ACLK and the first clock signal line R-BCLK.

Specifically, the first set of data lines R-ALVP1 (R-BLVP1) transmits red (R) sub-pixels data signals; the second set of data lines R-ALVP2 (R-BLVP2) transmits green (G) sub-pixels data signals; The third set of data lines R-ALVP3 (R-BLVP3) transmits blue (B) sub-pixels data signals.

Figure 12:
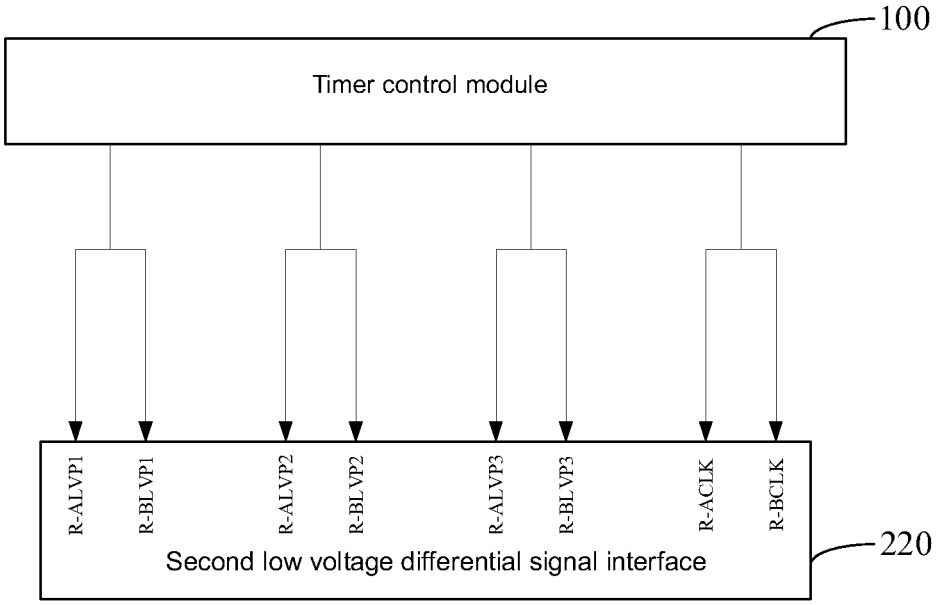
FIG. 12 is a schematic diagram of a short connection of data line of another embodiment.

Further, as shown in FIG. 12, for the present embodiment, the short connection of the data line of the output terminal of the timer control module 100 is:

The first set of data lines R-ALVP1, the second set of data lines R-ALVP2, and the third set of data lines R-ALVP3 of the first signal path is short connected to the corresponding first set of data lines R-BLVP1, the second set of data lines R-BLVP2, the third set of data lines R-BLVP3 of the second signal path, respectively;

The first clock signal line R-ACLK of the first signal path is short connected to the first clock signal line R-BCLK of the second signal path.

Further, in the present embodiment, the receiving data of the receiving terminal of the source driving module 300' is multiplexed as shown in Table 2 below:

TABLE 2

| Device | Data line | UD mode | UCFT mode |
|---|---|---|---|
| TCON | R-ALVP1~R-ALVP3 | P1→P3→ . . . →P959 | P1→P2→ . . . →P959→P960 |
| | R-ALVP4~R-ALVP6 | P2→P4→ . . . →P960 | NC |
| | R-BLVP1~R-BLVP3 | P961→P963→ . . . →P1919 | (Short to R-ALVP1~R-ALVP3) |
| | R-BLVP4~R-BLVP6 | P962→P964→ . . . →P1920 | NC |
| S-COF | R-ALVP1~R-ALVP3 | P1→P3→ . . . →P959 | P1(P1/P2)→P2(P3/P4)→ . . . → P480(P959/P960) |
| | R-ALVP4~R-ALVP6 | P2→P4→ . . . →P960 | NC |
| | R-BLVP1~R-BLVP3 | P961→P963→ . . . →P1919 | P481(P961/P962)→P482(P963/ P964)→ . . . →P960(P1919/P1920) |
| | R-BLVP4~R-BLVP6 | P962→P964→ . . . →P1920 | NC |

Wherein, "NC" in the table represents that there is no data line. In addition, the data multiplexing mode of the receiving terminal of the source driving module 300' is similar to that of Table 1, and will not be described here.

Figure 13:
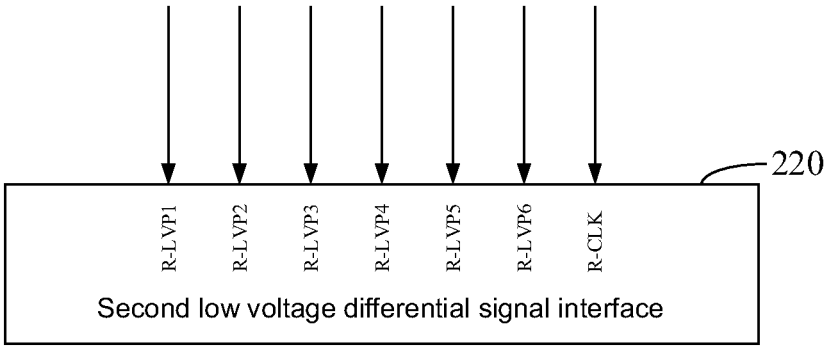
FIG. 13 is a schematic diagram of a low voltage differential signal interface of another embodiment.

In one embodiment, as shown in FIG. 13, the second low voltage differential signal interface 220 is provided with a signal path, the signal path includes six sets of data lines and a set of clock signal lines, the six sets of data lines in order are a first set of data lines R-LVP1, a second set of data lines R-LVP2, a third set of data lines R-LVP3, a fourth set of data lines R-LVP4, a fifth set of data lines R-LVP5, a sixth set of data lines R-LVP6. The set of clock signal lines is the first clock signal line R-CLK.

Specifically, the first set of data lines R-LVP1 and the fourth set of data lines R-LVP4 transmit red (R) sub-pixels data signals; the second set of data lines R-LVP2 and the fifth set of data lines R-LVP5 transmit green (G) sub-pixel data signal; the third set of data lines R-LVP3 and the sixth set of data lines R-LVP6 transmit blue (B) sub-pixels data signals.

Figure 14:
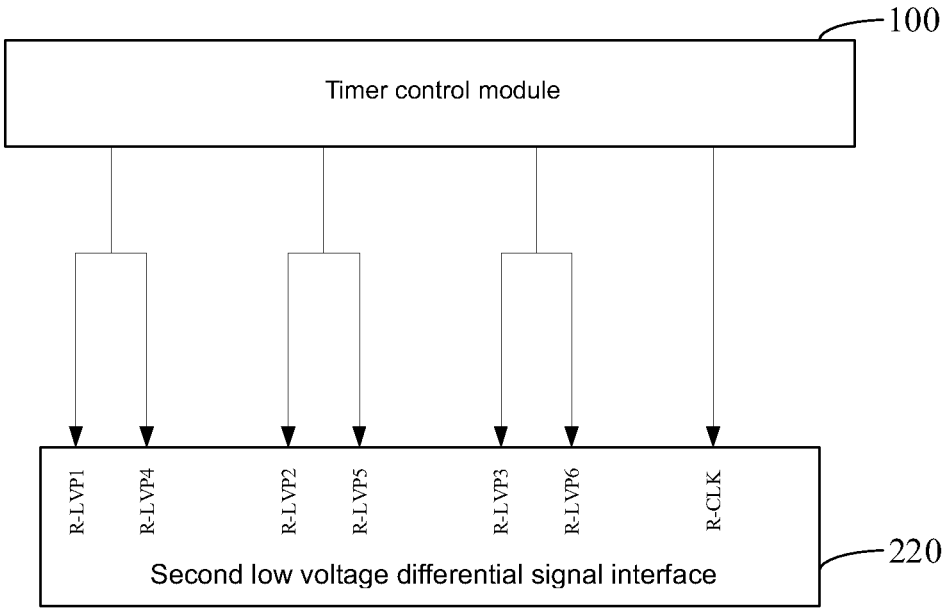
FIG. 14 is a schematic diagram of a short connection of data line of another embodiment.

Further, as shown in FIG. 14, for the present embodiment, the short connection of the data line of the output terminal of the timer control module 100 is:

The first set of data lines R-LVP1, the second set of data lines R-LVP2, and the third set of data lines R-LVP3 are short connected to the corresponding fourth set of data lines R-LVP4, the fifth set of data lines R-LVP5, and the sixth set of data line R-LVP6, respectively.

Figure 15:
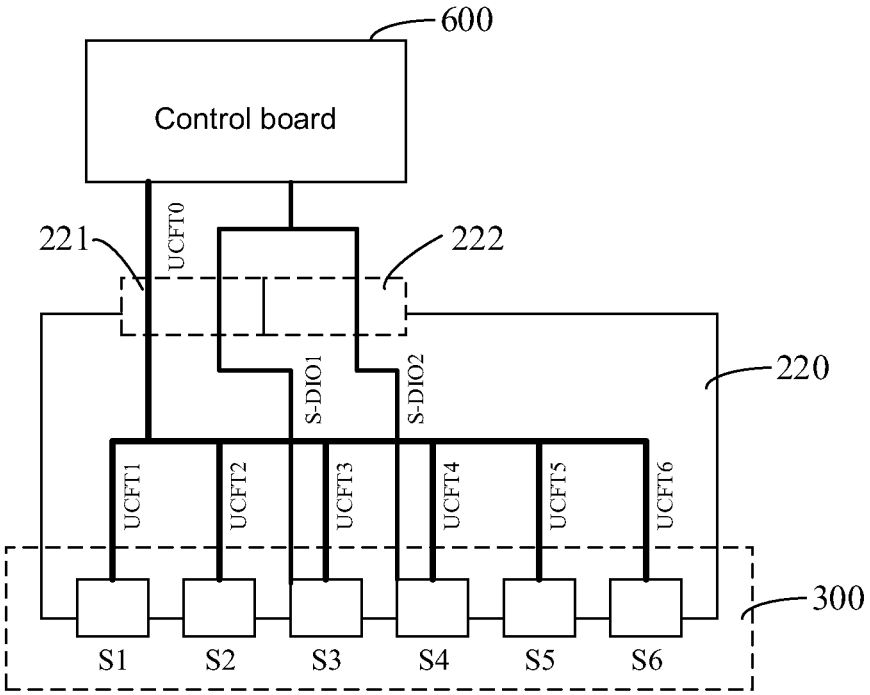
FIG. 15 is a schematic diagram of a receiving signal control of a source driving module of an embodiment.

In one embodiment, the receiving terminal of the driving module 300 is further provided with a data transmission trigger signal line and a data reception control signal line. Wherein the data transmission trigger signal line is used to transmit a signal for controlling the driving module 300 to start receiving data; the data reception control signal line is for transmitting a level control signal, to control the manner of the driving module 300 to receive data. Specifically, as shown in FIG. 15, the second low voltage differential signal interface 220 is provided with two signal paths, a first signal path 221 and a second signal path 222; each signal path has one of the data transmission trigger signal lines S-DIO1 and S-DIO2, respectively. Further, the driving module 300 connected to the second low voltage differential signal interface 220 is provided with six source driver chips S1, S2, S3, S4, S5 and S6, respectively. And each source drive chip is provided with a data reception control signal line, namely UCFT1, UCFT2, UCFT3, UCFT4 UCFT5 and UCFT6, respectively. The six data reception control signal lines are short connected and then combined into a data reception control signal line UCFT0, the data reception control signal line UCFT0 is taken out by the first signal path 221 or the second signal path 222, and connected to the control board 600. The control board 600 is provided with interfaces of different level values, and different level values are connected according to different drive requirements. For example, when UCFT0 is connected to high level, the UCFT mode is enabled, the TCON of the FHD can be used at this time, the corresponding data line in the output data line of TCON is short connected, and accompanying performing the data multiplexing function of the driving module 300, making the FHD image is display in the UD display panel. In addition, in the UCFT mode, one terminals of the data transmission trigger signal lines S-DIO1 and S-DIO2 are connected to the source driver chips S3 and S4, and the other terminals are short connected and then connected to the control board, and triggers the source driver chip to receive data by receiving a level signal of the control board.

Figure 16:
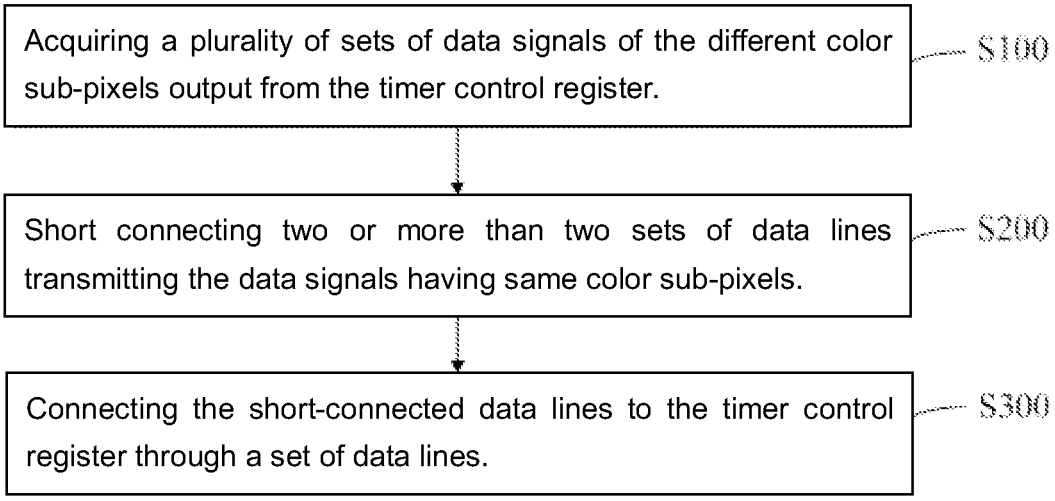
FIG. 16 is a flow chart of a driving method of a display device according to an embodiment.

FIG. 16 is a flow chart of a driving method of a display device according to an embodiment, the method includes:

Step S100: acquiring a plurality of sets of data signals of the different color sub-pixels output from the timer control register. The data signal output from the output terminal of the timer control register includes RGB data signals. That is, data signals of red, green and blue three sub-pixels. The data signals are transmitted through a plurality of sets of data lines to the receiving terminal of the source driver, the source driver can drive the display panel to display the image information through the data signal.

Step S200: short connecting two or more than two sets of data lines transmitting the data signals having same color sub-pixels.

Step S300: connecting the short-connected data lines to the timer control register through a set of data lines.

In the present embodiment, if the data lines for transmitting the same color sub-pixel information are short-connected, the data lines receiving the same color sub-pixel information at the receiving terminal of the source driver share a data output port. Therefore, by the above-described shorting method, when the image data of the lower resolution is inputted, it can be displayed on the display panel with the higher resolution.

Figure 17:
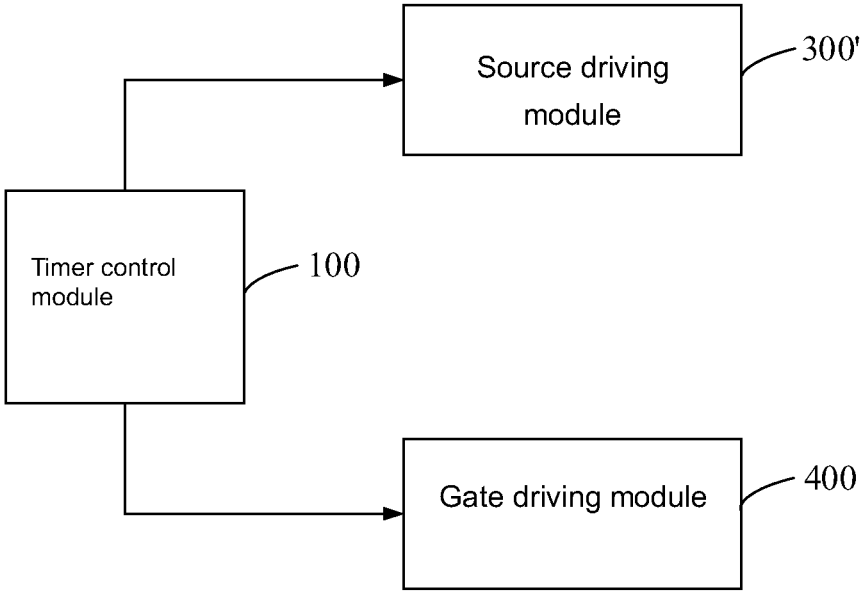
FIG. 17 is a schematic block diagram of a driving device of a display device according to an embodiment.

FIG. 17 is a schematic view of a driving device of a display device according to another embodiment, the driving device includes: a timer control module 100, a source driving module 300', and a gate driving module 400. Wherein, the output terminal of the timer control module 100 outputs the data signals of the different color sub-pixels to the source driving module 300' through the plurality of sets of data lines; the two sets of the data lines transmitting the data signal of the same color sub-pixel of the source driving modules 300' are short connected, after the short connection is connected to the output terminal of the timer control module 100 through a set of data lines; the gate driving module 400 is connected to the timer control module 100, and outputs driving voltage signals through a plurality of sets of scanning lines, and the driving voltage signals of the two adjacent scanning lines of the scanning lines of each set is synchronized.

Figure 18:
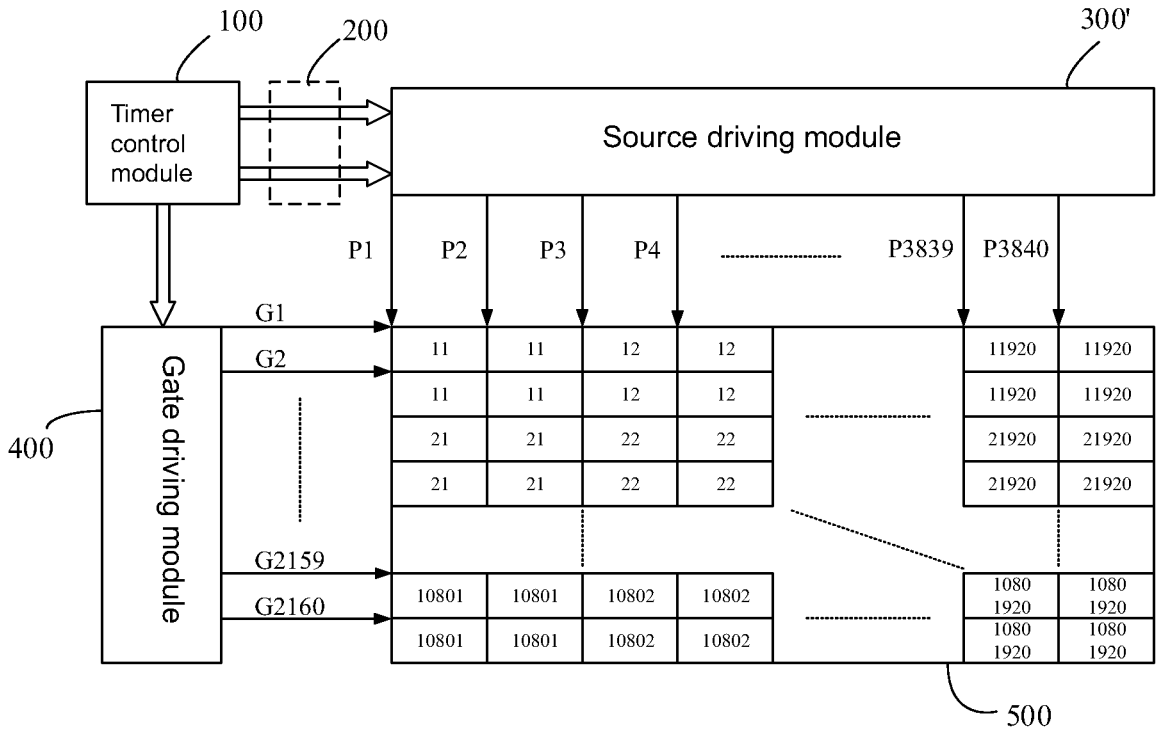
FIG. 18 is a schematic block diagram of a display device according to an embodiment.

Specifically, as shown in FIG. 18, the display device of one embodiment includes a display panel 500, and the above-described driving device. Wherein, the display panel includes: LCD display panel, OLED display panel, curved surface display panel or other display panel.

Further, when the display device is a liquid crystal display device, the display device may be a TN, an OCB, a VA type, a curved surface type liquid crystal display device, but the present invention is not limited thereto. Wherein, the liquid crystal display device can use the direct type backlight, the backlight source can be white, RGB three-color light source, WRGB four-color light source or YRGB four-color light source, but not limited to this.

Specifically, referring to FIG. 18, the display device includes: the timer control module 100, the low voltage differential signal interface 200, the source driving module 300', the gate driving module 400, and the display panel 500. Wherein, the timer control module 100 is a timer control register of the FHD, and the display panel 500 is a UD display panel.

Wherein, each of the small squares in the display panel 500 represents one sub-pixel, and the square having the same number indicates that the display image information of the sub-pixel is the same.

It can be seen that, the display device uses the timer control register of the FHD, that is, the image information inputted is the resolution of FHD (1920*080), and the data is copied by the above-described driving device, so that the image information is displayed on the display panel 500 with the UD (3840*2160) resolution.

The above-described display device is designed by the short connection of the data lines on the output path of the timer control module, so that the receiving data of the source driving module is multiplexed, so that the display panel driving method with lower resolution can be applied to the display panel of higher resolution. The above application simplifies the drive circuit architecture, reducing production costs.

The technical features of the embodiments described above can be arbitrarily combined, and in order to make the description simple and not possible, all possible combinations of the respective technical features in the above embodiments are not described. However, as long as there is no contradiction in the combination of these technical features, should be considered as the scope of this manual.

The foregoing contents are detailed description of the disclosure in conjunction with specific preferred embodiments and concrete embodiments of the disclosure are not limited to these descriptions. For the person skilled in the art of the disclosure, without departing from the concept of the disclosure, simple deductions or substitutions can be made and should be included in the protection scope of the application.

What is claimed is:

1. A driving device of a display device, comprising:

a timer control module, an output terminal of the timer control module outputting a plurality of sets of data signals of different color sub-pixels;

a driving module, a receiving terminal of the driving module receiving the data signals from the timer control module; and a plurality of sets of data lines, wherein the plurality of sets of data lines are connected to the timer control module and the driving module, two or more than two sets of the data lines connecting to the driving module for transmitting the data signal of the same color sub-pixel are short connected, and are connected to the output terminal of the timer control module through a set of data lines after the short connection;

a low voltage differential signal interface, and wherein the driving module is a source driving module; the low voltage differential signal interface connected to the output terminal of the timer control module and the receiving terminal of the source driving module, respectively;

wherein, the low voltage differential signal interface comprising two signal paths, a first signal path and a second signal path, respectively; each signal path comprising six sets or three sets of data lines and a set of clock signal lines;

wherein, the six sets of data line are a first set of data lines, a second set of data lines, a third set of data lines, a fourth set of data lines, a fifth set of data lines, a sixth set of data lines, sequentially;

the three sets of data line are the first set of data lines, the second set of data lines, the third set of data lines, sequentially;

the set of clock signal lines are first clock signal lines;

wherein, the first set of data lines and the fourth set of data lines transmit a first sub-pixel data signals, the second set of data lines and the fifth set of data lines transmit a second sub-pixel data signals, and the third set of data lines and the sixth set of data lines transmit a third sub-pixel data signals.

2. The driving device of the display device according to claim 1, further comprising a gate driving module;

the gate driving module connected to the timer control module, and outputting driving voltage signals through a plurality of sets of scanning lines, and each set of scanning lines comprising a plurality of adjacent scanning lines; and the timer control module controlling the gate driving module to output the driving voltage signals, making the driving voltage signals of the scanning lines in each set of scanning lines synchronized, and each set of scanning lines sequentially transmitting the driving voltage signals.

3. The driving device of the display device according to claim 1, wherein each of the signal path comprises six sets of data lines;

the first set of data lines, the second set of data lines, and the third set of data lines of the first signal path are short connected to the corresponding first set of data lines, the second set of data lines, the third set of data lines of the second signal path, respectively;

the fourth set of data lines, the fifth set of data lines, and the sixth set of data lines of the first signal path are short connected to the corresponding fourth set of data lines, the fifth set of data lines, the sixth set of data lines of the second signal path, respectively; and the first clock signal line of the first signal path is short connected to the first clock signal line of the second signal path.

4. The driving device of the display device according to claim 3, wherein the low voltage differential signal interface comprises a first low voltage differential signal interface and a second low voltage differential signal interface, the first low voltage differential signal interface is for transmitting a data information of a left half panel, and the second low voltage differential signal interface is for transmitting the data information of a right half panel.

5. The driving device of the display device according to claim 4, further comprising a gate driving module;

the gate driving module connected to the timer control module, and outputting driving voltage signals through a plurality of sets of scanning lines, and each set of scanning lines comprising a plurality of adjacent scanning lines; and the timer control module controlling the gate driving module to output the driving voltage signals, making the driving voltage signals of the scanning lines in each set of scanning lines synchronized, and each set of scanning lines sequentially transmitting the driving voltage signals.

6. The driving device of the display device according to claim 1, wherein each of the signal path comprises six sets of data lines;

the first set of data lines, the second set of data lines, and the third set of data lines of the first signal path are short connected to the corresponding fourth set of data lines, the fifth set of data lines, the sixth set of data lines of the second signal path, respectively;

the fourth set of data lines, the fifth set of data lines, and the sixth set of data lines of the first signal path are short connected to the corresponding first set of data lines, the second set of data lines, the third set of data lines of the second signal path, respectively; and the first clock signal line of the first signal path is short connected to the first clock signal line of the second signal path.

7. The driving device of the display device according to claim 6, wherein the low voltage differential signal interface comprises a first low voltage differential signal interface and a second low voltage differential signal interface, the first low voltage differential signal interface is for transmitting a data information of a left half panel, and the second low voltage differential signal interface is for transmitting the data information of a right half panel.

8. The driving device of the display device according to claim 7, further comprising a gate driving module;

the gate driving module connected to the timer control module, and outputting driving voltage signals through a plurality of sets of scanning lines, and each set of scanning lines comprising a plurality of adjacent scanning lines; and the timer control module controlling the gate driving module to output the driving voltage signals, making the driving voltage signals of the scanning lines in each set of scanning lines synchronized, and each set of scanning lines sequentially transmitting the driving voltage signals.

9. The driving device of the display device according to claim 1, wherein each of the signal path comprises six sets of data lines;

the first set of data lines and the fourth set of data lines of the first signal path are short connected to the corresponding first set of data lines and the fourth set of data lines of the second signal path, respectively;

the second set of data lines and the fifth set of data lines of the first signal path are short connected to the corresponding second set of data lines and the fifth set of data lines of the second signal path, respectively;

the third set of data lines and the sixth set of data lines of the first signal path are short connected to the corresponding third set of data lines and the sixth set of data lines of the second signal path, respectively;

the first clock signal line of the first signal path is short connected to the first clock signal line of the second signal path.

10. The driving device of the display device according to claim 9, wherein the low voltage differential signal interface comprises a first low voltage differential signal interface and a second low voltage differential signal interface, the first low voltage differential signal interface is for transmitting a data information of a left half panel, and the second low voltage differential signal interface is for transmitting the data information of a right half panel.

11. The driving device of the display device according to claim 10, further comprising a gate driving module;

the gate driving module connected to the timer control module, and outputting driving voltage signals through a plurality of sets of scanning lines, and each set of scanning lines comprising a plurality of adjacent scanning lines; and the timer control module controlling the gate driving module to output the driving voltage signals, making the driving voltage signals of the scanning lines in each set of scanning lines synchronized, and each set of scanning lines sequentially transmitting the driving voltage signals.

12. The driving device of the display device according to claim 1, wherein each of the signal path comprises three sets of data lines;

the first set of data lines, the second set of data lines and the third set of data lines of the first signal path are short connected to the corresponding first set of data lines, the second set of data lines and the third set of data lines of the second signal path, respectively; and the first clock signal line of the first signal path is short connected to the first clock signal line of the second signal path.

13. The driving device of the display device according to claim 12, wherein the low voltage differential signal interface comprises a first low voltage differential signal interface and a second low voltage differential signal interface, the first low voltage differential signal interface is for transmitting a data information of a left half panel, and the second low voltage differential signal interface is for transmitting the data information of a right half panel.

14. The driving device of the display device according to claim 13, further comprising a gate driving module;

the gate driving module connected to the timer control module, and outputting driving voltage signals through a plurality of sets of scanning lines, and each set of scanning lines comprising a plurality of adjacent scanning lines; and the timer control module controlling the gate driving module to output the driving voltage signals, making the driving voltage signals of the scanning lines in each set of scanning lines synchronized, and each set of scanning lines sequentially transmitting the driving voltage signals.

15. The driving device of the display device according to claim 1, wherein the low voltage differential signal interface comprises a signal path, the signal path comprises six sets of data lines; and the first set of data lines, the second set of data lines and the third set of data lines are short connected to the corresponding fourth set of data lines, the fifth set of data lines and the sixth set of data lines, respectively.

16. The driving device of the display device according to claim 15, wherein the low voltage differential signal interface comprises a first low voltage differential signal interface and a second low voltage differential signal interface, the first low voltage differential signal interface is for transmitting a data information of a left half panel, and the second low voltage differential signal interface is for transmitting the data information of a right half panel.

17. The driving device of the display device according to claim 1, further comprising a gate driving module;

the gate driving module connected to the timer control module, and outputting driving voltage signals through a plurality of sets of scanning lines, and each set of scanning lines comprising a plurality of adjacent scanning lines; and the timer control module controlling the gate driving module to output the driving voltage signals, making the driving voltage signals of the scanning lines in each set of scanning lines synchronized, and each set of scanning lines sequentially transmitting the driving voltage signals.

18. A driving method of a display device, comprising:

acquiring a plurality of sets of data signals of the different color sub-pixels outputting from a low voltage differential signal interface by a timer control register, wherein the low voltage differential signal interface comprising two signal paths, a first signal path and a second signal path, respectively; each signal path comprising six sets or three sets of data lines and a set of clock signal lines; wherein, the six sets of data line are a first set of data lines, a second set of data lines, a third set of data lines, a fourth set of data lines, a fifth set of data lines, a sixth set of data lines, sequentially; the three sets of data line are the first set of data lines, the second set of data lines, the third set of data lines, sequentially; the set of clock signal lines are first clock signal lines; wherein, the first set of data lines and the fourth set of data lines transmit a first sub-pixel data signals, the second set of data lines and the fifth set of data lines transmit a second sub-pixel data signals, and the third set of data lines and the sixth set of data lines transmit a third sub-pixel data signals;

short connecting two or more than two sets of data lines transmitting the data signals having same color sub-pixels; and connecting the short-connected data lines to the timer control register through a set of data lines.

19. A driving device of the display device, comprising:

a timer control module, an output terminal of the timer control module outputting a plurality of sets of data signals of different color sub-pixels to a source driving module;

the source driving module, wherein two sets of the data lines for transmitting the data signal of the same color sub-pixel of the source driving modules are short connected, and are connected to the output terminal of the timer control module through a set of data lines after the short connection; and a gate driving module, wherein the gate driving module is connected to the timer control module, and is for outputting driving voltage signals through a plurality of sets of scanning lines, and the driving voltage signals of two adjacent scanning lines of the scanning lines of each set are synchronized;

a low voltage differential signal interface, wherein the low voltage differential signal interface connected to the output terminal of the timer control module and the source driving module, respectively;

wherein, the low voltage differential signal interface comprising two signal paths, a first signal path and a second signal path, respectively; each signal path comprising six sets or three sets of data lines and a set of clock signal lines;

wherein, the six sets of data line are a first set of data lines, a second set of data lines, a third set of data lines, a fourth set of data lines, a fifth set of data lines, a sixth set of data lines, sequentially;

the three sets of data line are the first set of data lines, the second set of data lines, the third set of data lines, sequentially;

the set of clock signal lines are first clock signal lines;

wherein, the first set of data lines and the fourth set of data lines transmit a first sub-pixel data signals, the second set of data lines and the fifth set of data lines transmit a second sub-pixel data signals, and the third set of data lines and the sixth set of data lines transmit a third sub-pixel data signals.

* * * * *